United States Patent [19]

Liu

[11] Patent Number: 4,788,727

[45] Date of Patent: Dec. 6, 1988

[54] COLLAPSIBLE BASE FOR BEDS

[75] Inventor: Dean S. Liu, Agincourt, Canada

[73] Assignee: Halcyon Waterbed Inc., Downsview, Canada

[21] Appl. No.: 135,681

[22] Filed: Dec. 21, 1987

[30] Foreign Application Priority Data

Jul. 9, 1987 [CA] Canada ..... 541677

[51] Int. Cl.[4] ..... A47C 19/12

[52] U.S. Cl. ..... 5/174; 5/177; 5/202

[58] Field of Search ..... 5/174, 176 R, 176 B, 5/177, 400, 200 R, 202, 203, 451, 452

[56] References Cited

U.S. PATENT DOCUMENTS

| | | | |
|---|---|---|---|
| 1,724,852 | 8/1929 | Scott | 5/174 |
| 2,568,546 | 9/1951 | Hoeft | 5/174 |
| 2,790,185 | 4/1957 | Fox | 5/174 |
| 3,100,304 | 8/1963 | Brandlin et al. | 5/174 X |
| 3,761,970 | 10/1973 | Fredman | 5/176 R X |
| 3,881,202 | 5/1975 | Tyhanic | 5/176 R |
| 4,048,683 | 9/1977 | Chen | 5/174 X |
| 4,391,008 | 7/1983 | Yamaoka et al. | 5/200 R |
| 4,507,815 | 4/1985 | Danko | 5/400 |

*Primary Examiner*—Ramon O. Ramirez

*Attorney, Agent, or Firm*—Riches, McKenzie & Herbert

[57] ABSTRACT

A collapsible bed base is disclosed to support a bed mattress. The bed base comprises a foldable peripheral frame, removable cross-support joist members extending across the frame and removable top decking panels supported by the frame and across-support members for supporting a mattress thereon. The foldable peripheral support frame assumes a rectangular configuration in an open position. The frame members at the opposed ends of the frame have a hinge in their center. These frame members at the ends of the frame are also hinged to frame members forming the sides of the frame. The frame members at the ends of the frame can be bent inwardly about their centers so as to draw the side frame members together into a collapsed position.

12 Claims, 5 Drawing Sheets

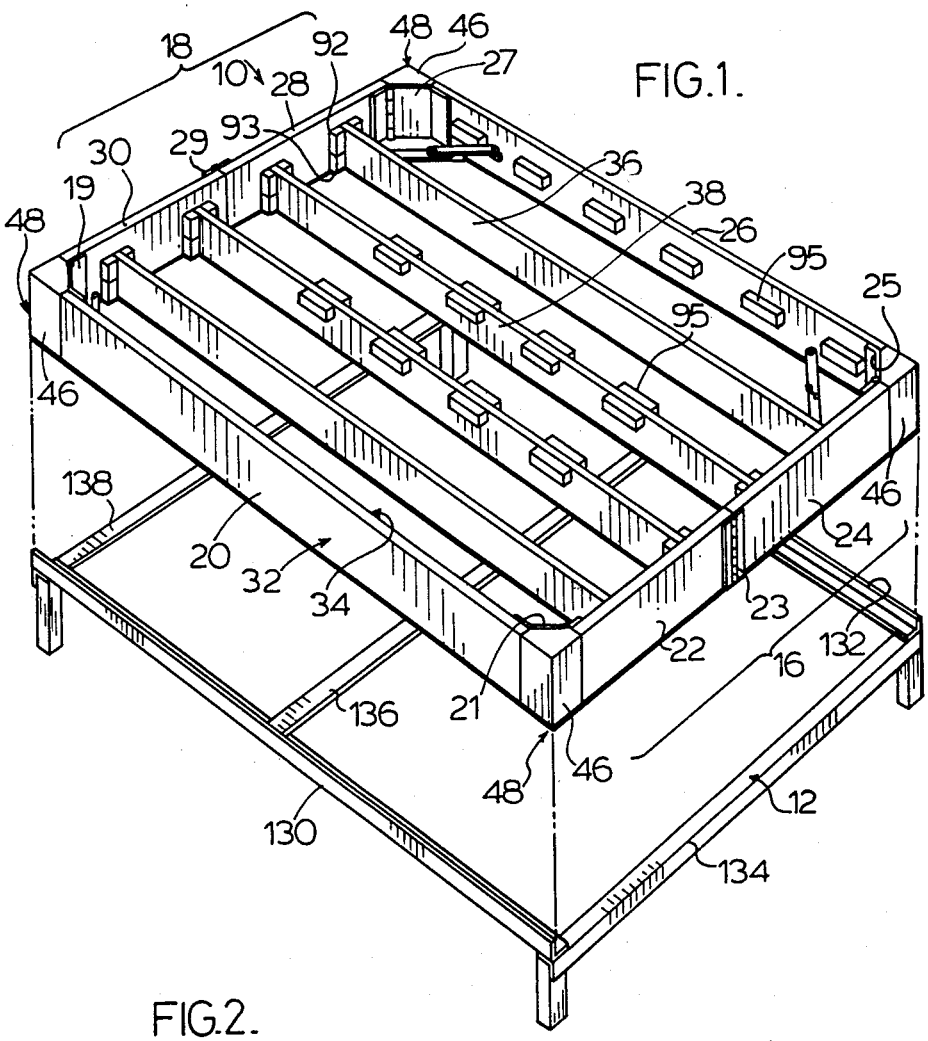
FIG.1.
FIG.2.
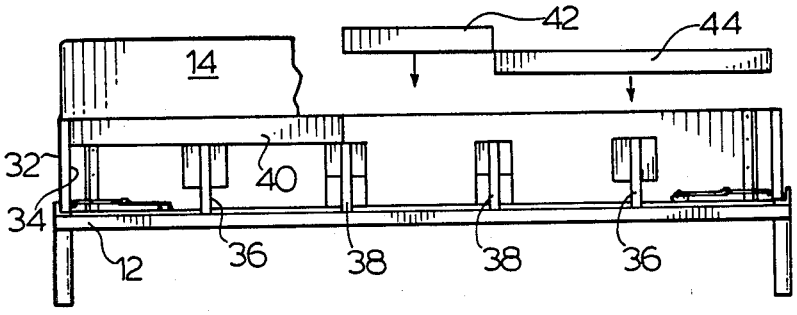

FIG. 9.
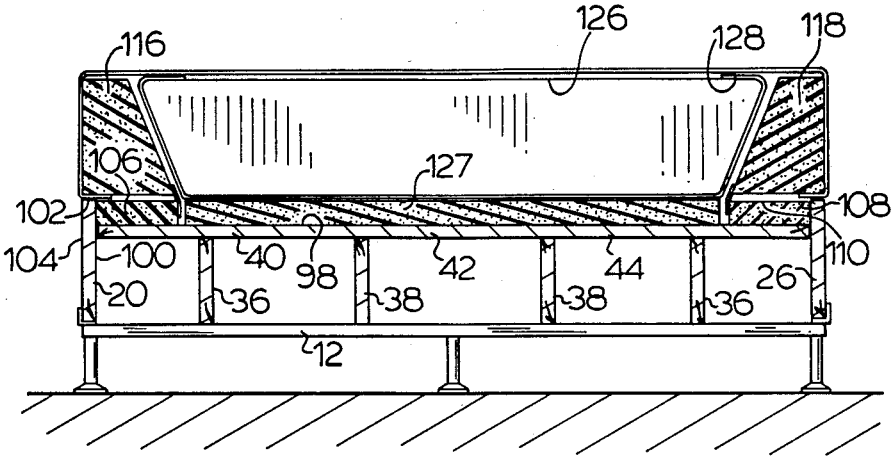
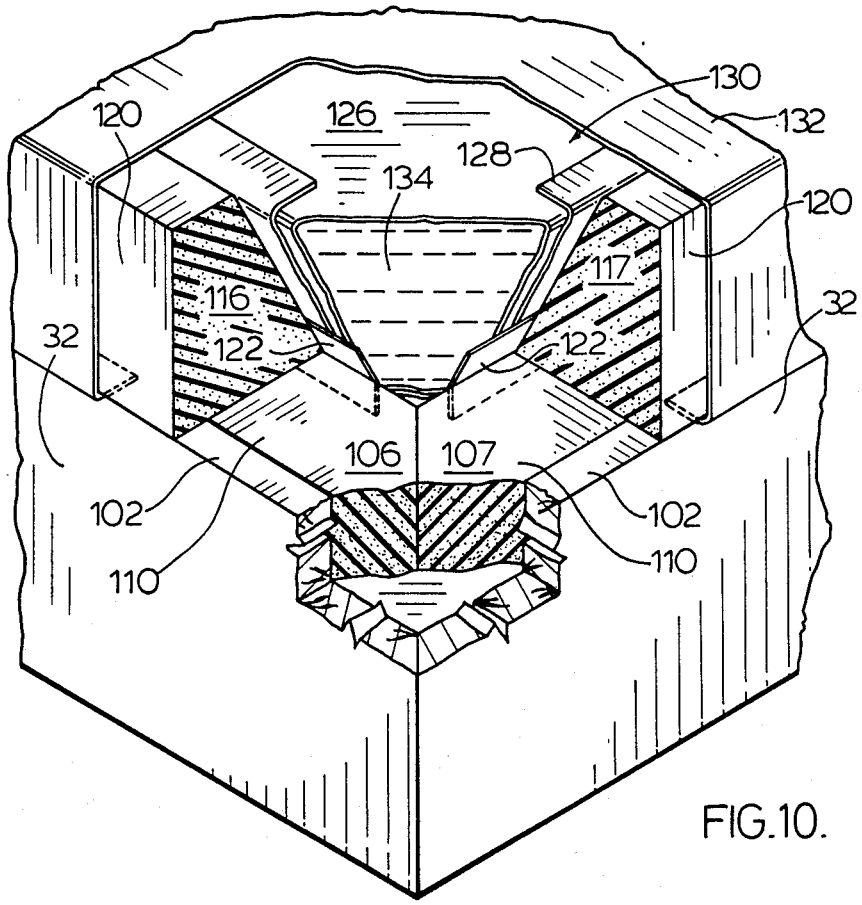
FIG. 10.

COLLAPSIBLE BASE FOR BEDS

SCOPE OF THE INVENTION

This invention relates to collapsible bases to support bed mattresses and more particularly to an improved construction for a bed base incorporating a foldable, peripheral frame. Additionally the invention also relates to a bed base particularly adapted for use with a complementary collapsible hybrid waterbed mattress.

BACKGROUND OF THE INVENTION

Bed assemblies are well known in which a bed mattress is supported on a base. Common bed mattresses include spring mattresses, foam mattresses of foamed plastic material, air mattresses having an inflatable air bladder, and hybrid waterbed mattresses. Hybrid waterbed mattresses have the appearance of known spring mattresses but contain a fluid-filled bladder.

Bases for beds include well known box springs as well as more rigid base constructions commonly used with foam mattresses and made entirely out of wood.

Known bed bases suffer the disadvantage that they can not be collapsed and accordingly occupy a disadvantageously large amount of space in shipping and storage.

Knock-down constructions for furniture are known. Many knock-down constructions suffer the disadvantage that they can not be assembled or disassembled without the assistance of tools.

Bases for foam bed mattresses frequently incorporate rigid frame members made for example of wood planking. Such planking suffers the disadvantage, particularly at the corners of the base, of providing hard edges which are easily bumped when walking about a bed causing discomfort. Most known protective corner bumpers suffer the disadvantage of either not providing adequate protection or not being adaptable for a collapsible construction.

U.S. Pat. No. 4,057,862 to LaBianco teaches a hybrid waterbed construction. LaBianco's construction suffers the disadvantage that neither the bed base nor the hybrid waterbed mattress can be readily collapsed. In LaBianco, the structure providing peripheral support to the waterbed bladder is in the form of an integral frame which requires the use of tools for assembly.

SUMMARY OF THE INVENTION

Accordingly, to at least partially overcome these disadvantages of previous devices, the present invention provides a collapsible bed base including a foldable peripheral frame whose frame members are permanently hinged together and carry corner bumper members permanently affixed thereto. The foldable frame is adapted to receive removable cross-support joist members and support a removable top decking.

An object of the present invention is to provide a collapsible bed base incorporating a frame with peripheral frame members hinged together for folding into a collapsed position.

Another object is to provide a novel hinge construction for use in a collapsible bed base which permits substantial corner bumper members to be provided at the corners of a frame forming the base.

Another object is to provide a collapsible bed base which can be erected and collapsed without tools yet folds into a relatively compact configuration for storage and shipping.

Another object is to provide a construction for a hybrid waterbed comprising a bed base and a complementary collapsible hybrid waterbed mattress which can readily be assembled and disassembled.

In one of its aspects the present invention provides a collapsible bed base to support a bed mattress thereon. The bed base comprises a foldable peripheral frame, removable cross-support joist members extending across the frame and removable top decking panels supported by the frame and cross-support members for supporting -a mattress thereon.

In another of its aspects, the present invention provides a collapsible base for a bed comprising:

(a) a foldable peripheral frame for a collapsible base, said peripheral frame assuming a rectangular configuration in an open position, said peripheral frame comprising:

(i) two horizontal elongate continuous frame members forming two opposite sides of the frame, each having two ends, (ii) two horizontal elongate split frame members forming two other opposite sides of the frame, each split frame member comprising (A) two elongate segments of equal length, each having a central end and an outer end, and (B) center hinge means hingedly coupling together the central ends of the segments for pivoting about a vertical axis, (iii) four corner hinge means, each hingedly coupling an outer end of one of the segments of the split frame members to an end of one of the continuous frame members for pivoting about a vertical axis, wherein with said frame in an open position movement of the center hinge means towards each other with pivoting of the segments about the center hinge means and complementary pivoting of the segments about the corner hinge means will move the continuous frame members towards each other to a collapsed position in which segments of each split frame member are folded upon each other to both lie substantially parallel to the continuous frame members, (b) a plurality of removable elongate joist members extending when the frame is in an open position between the split frame members spaced from each other, the joist members coupled at each of their ends to the split frame members, (c) support block means on inside surfaces of the continuous frame members, and (d) a plurality of removable support decking means supported within the frame in side by side abutting relation resting on the support blocks and joist members to provide a continuous horizontal support surface.

In another aspect, the present invention provides a framework for confining a water-filled bladder of a waterbed, the frame work comprising:

platform means for supporting the bladder, side wall means peripherally about the platform means rising upwardly above the periphery of the platform means, the side wall means having an inner wall surface at a height above the platform means and a peripheral outer wall surface, a plurality of elongate support block members arranged end-to-end on the platform means to encircle the periphery of the platform means forming a peripheral band thereabout with each support block member lying along side of and in abutment with the inner wall surface with the side wall means preventing outward sliding movement of each support block member, each support block member presenting an upper surface located at the same height as and comprising a co-planar extension of the top surface of the side wall means, lateral support means for extending about the periphery of the bladder to provide lateral support for the periphery of the bladder, the lateral support means comprising a plurality of lateral support members, each coupled to an associated one-of the support block members, each lateral support member overlying its associated support block member and the top surface of the side wall means adjacent thereto with an outer surface of each lateral support member comprising a coplanar extension of the outer wall surface of the side wall means adjacent thereto, a lower innermost edge of each lateral support member coupled by hinge means to its associated support block member to enable the lateral support member to pivot upward away from the top surface of the side wall means and its associated support block member, each lateral support member and its associated block support member being removable as an integral element.

The present invention firstly provides a collapsible bed base. The base comprises a foldable, peripheral frame, cross-support joist members, and top decking panels. The top decking panels are supported by the frame and cross-support joist members and a bed mattress is to be supported on the top decking panels. The mattress to be supported may be of any type whether spring, foam, air or hybrid waterbed type.

A preferred foldable frame is made from wood planking. Two side frame members are provided as continuous horizontal plankings joined at each of their ends by corner hinge members to horizontal planking forming end frame members. The corner hinge member permits pivoting of the side frame members about first vertical axes relative to the end frame members. Each end frame member comprises two equal length segments of planking joined together at central ends thereof by central hinge members for pivoting about second vertical axes. The frame can be folded from an open rectangular position to a collapsed position by simultaneous pivoting about the first and second axes so as to move center hinge members inwardly while the side frame members are drawn closer together.

Preferably the foldable frame may have protective bumpers at each of its corners. The bumpers can have sufficient thickness to permit compression of the bumper to readily absorb accidental impacts by a user. To accomplish this, the side and end frame members preferably terminate a substantial distance from the corner of the frame, with a diagonal bracket member extending diagonally across the corner to connect ends of the side and end frame members. This bracket member includes a corner hinge member to pivotably mount the frame members relative to one another. The bumper may be coupled to one frame member so as to not interfere with folding of the frame between open and closed positions.

The invention also provides a novel construction for a framework to provide lateral support to a hybrid waterbed mattress and in this regard provides a novel construction for a base and a complementary collapsible hybrid waterbed mattress. Side walls of a peripheral frame are provided to extend a small height above a platform to support a waterfilled bladder. Elongate support blocks are provided to rest on the platform along each side wall with the tops of the support blocks having the same height above the platform as the side walls. The support blocks can not be moved laterally outwardly by reason of their abutting the upstanding side walls. Elongate peripheral support members of foamed plastic are provided to overlie both the support blocks and the side wall. The peripheral support members are hinged at an inner, lower edge to their associated support blocks to provide lateral support to the water-filled bladder yet permit pivoting of the peripheral support members relative to the support block. Each support block and its coupled peripheral support member can readily be removed as a unit as they both merely rest on the platform.

BRIEF DESCRIPTION OF THE DRAWINGS

Further aspects and advantages of the invention will appear from the following description taken together with the accompanying drawings in which:

FIG. 1 is a perspective view of a frame for a bed base in accordance with the present invention in a fully open position above an optional lower metal frame;

FIG. 2 is an end cross-sectional view of the frame shown in FIG. 1 and schematically showing three panels adapted to provide, a platform flooring for the base upon which a bed mattress is to be supported;

FIG. 9 is an end cross-sectional view showing a hybrid waterbed construction utilizing the frame shown in FIG. 1; and FIG. 10, is a partially cut away pictorial view showing the bed of FIG. 9.

DETAILED DESCRIPTION OF THE DRAWINGS

Figure 3:
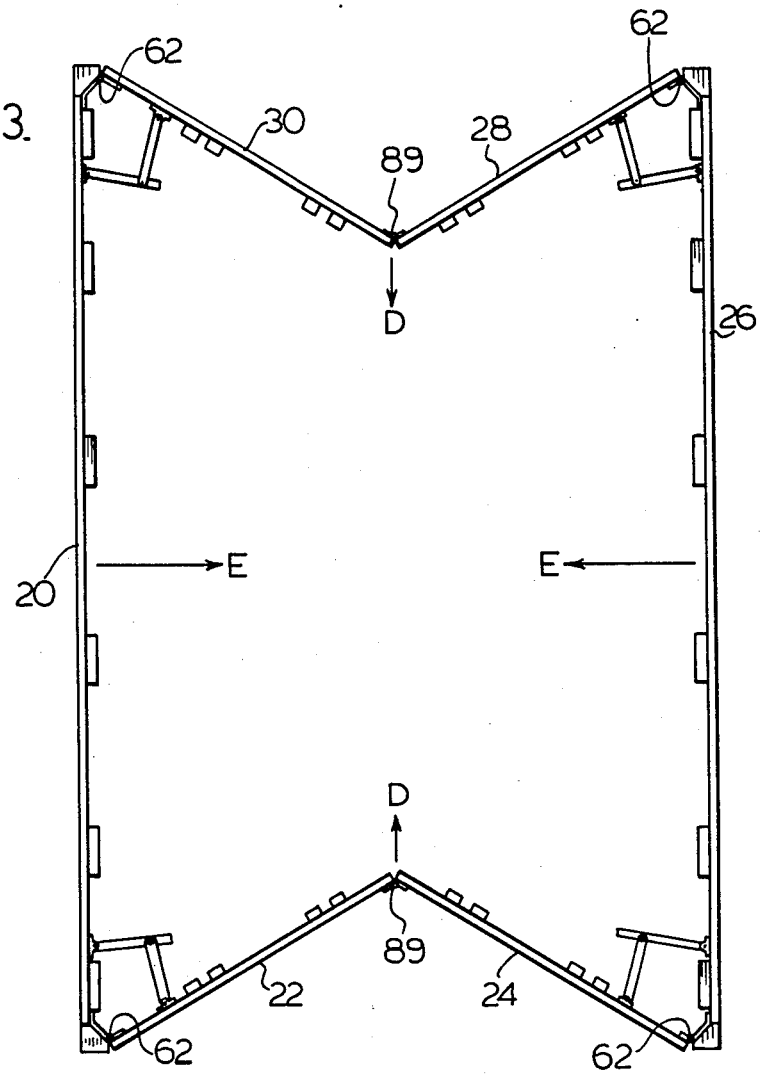
FIG. 3 is a top plan view of the frame of FIG. 1 in a partially collapsed position.

Reference is made first to FIGS. 1 and 2 showing a preferred frame for a bed base in accordance with the present invention. The frame, generally indicated as 10 is shown mounted on an optional support 12 comprising a framework of elongate rail members of metal angle iron as is well known to support conventional box spring-type bases for bed mattresses. Frame support 12 comprises two side rails 130 and 132 and three cross rails 134, 136 and 138. Preferably frame support is collapsable.

FIG. 2 best shows the entire base comprising frame 10, removable joist members 36 and 38 and removable flooring panels 40, 42 and 44. The base is to support a bed mattress schematically shown as a conventional spring mattress 14 in FIG. 2.

In an open position as seen in FIG. 1, the frame comprises an upstanding peripheral frame assembly of two split end frame members generally indicated 16 and 18 and two side frame members 20 and 26. Removable joist members 36 and 38 extend between the end frame members and support three removable flooring panels 40, 42 and 44 providing a platform upon which mattress 14 is supported. While, as seen in FIG. 2 panels 40, 42 and 44 are flush with the top of frame 10, the panels may be at a height lower than the top of frame 10 so as to be recessed.

Split end frame member 16 comprises two equal length frame segments 22 and 24 hingedly coupled together at their central ends by center hinge 23. Split end frame member 18 comprises two equal length frame segments 28 and 30 joined together at their central ends by center hinge 29.

Diagonal bracket members 19, 21, 25 and 27 are coupled to the ends of each of side frame members 20 and 26 and hingedly coupled at ends of the side frame members to adjacent segments of the end frame members.

Figure 7:
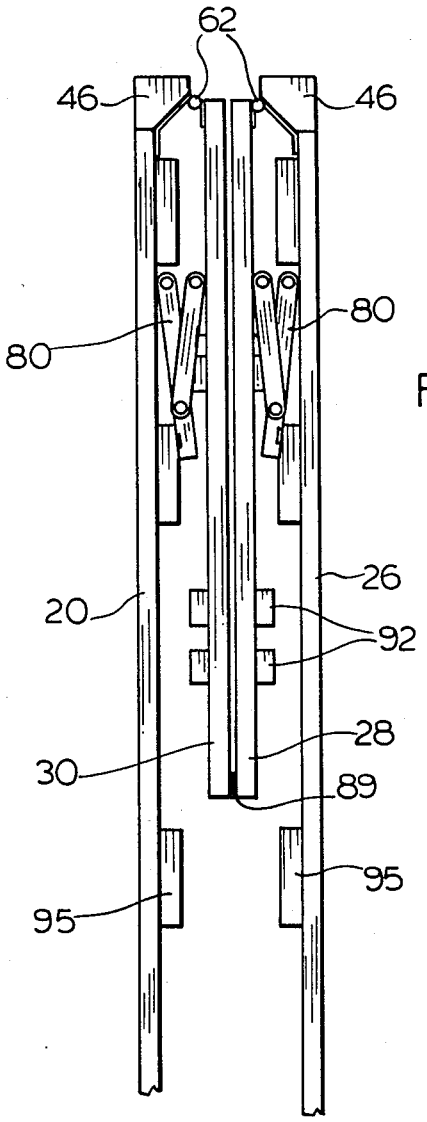
FIG. 7 is top plan view of one half of the frame of FIG. 1 in a dully collapsed position.

As seen in FIG. 3, with the flooring panels and joists members removed, the frame may be collapsed from the open position by folding the segments of the end frame members about their center hinges 23 and 29 to move the center hinges closer together, simultaneously with pivoting the segments of the end frame members with respect to the side frame members 20 and 26. In this manner the side frame members 20 and 26 may be drawn together as shown by arrows E in FIG. 3 towards assuming a fully collapsed position as shown in FIG. 7.

The frame members 16, 18, 20 and 26 may be seen to comprise plank-like members, preferably of wood and having a relatively small thickness between vertically orientated outer surfaces generally designated 32 and inside surfaces generally designated 34.

A corner bumper member 46 is provided at each corner of the frame as seen in FIG. 1. Bumper member 46 preferably is resilient, formed for example from an elastomeric, foamed plastic material such as polyurethane foam and serves to protect persons who may, on moving around the frame bump into a corner. With bumper member 46, as seen in FIG. 1, the frame assumes a rectangular shape in plan view when fully open having four corners and an apex generally indicated 48 at each corner.

Figure 4:
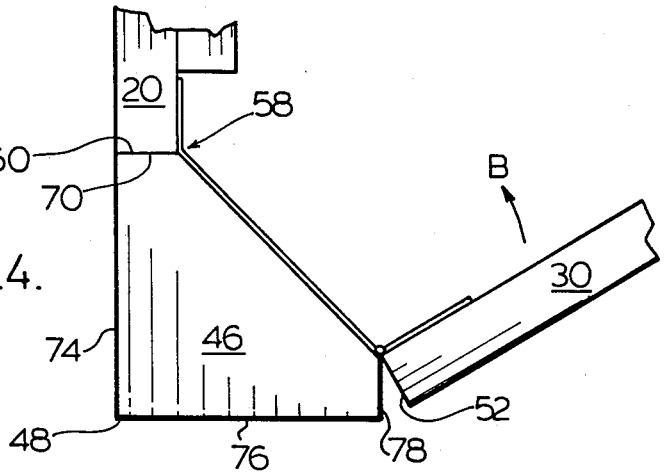
FIG. 4 is an enlarged view of FIG. 3 showing a corner of the frame.
Figure 3:
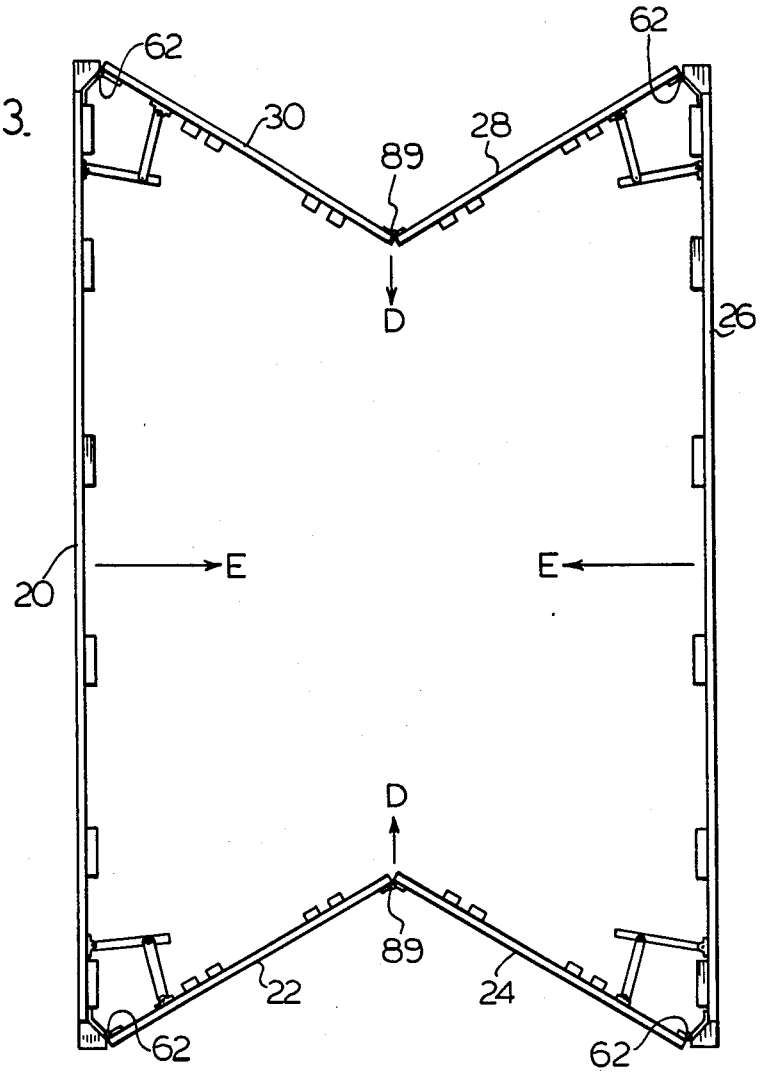
Figure 4:
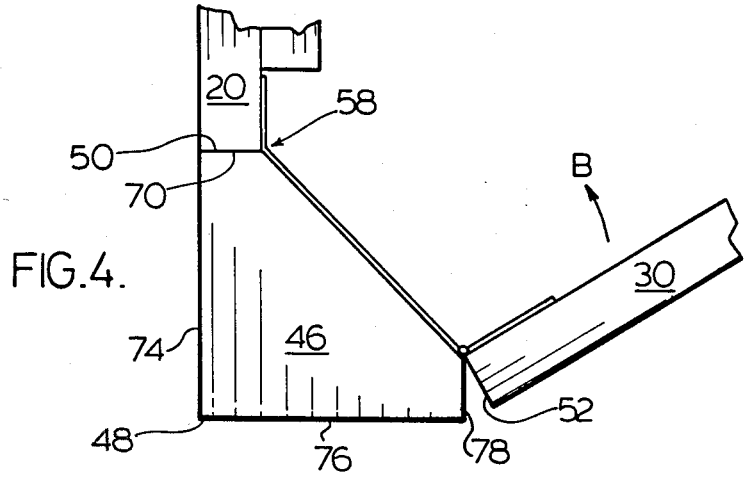
Figure 6:
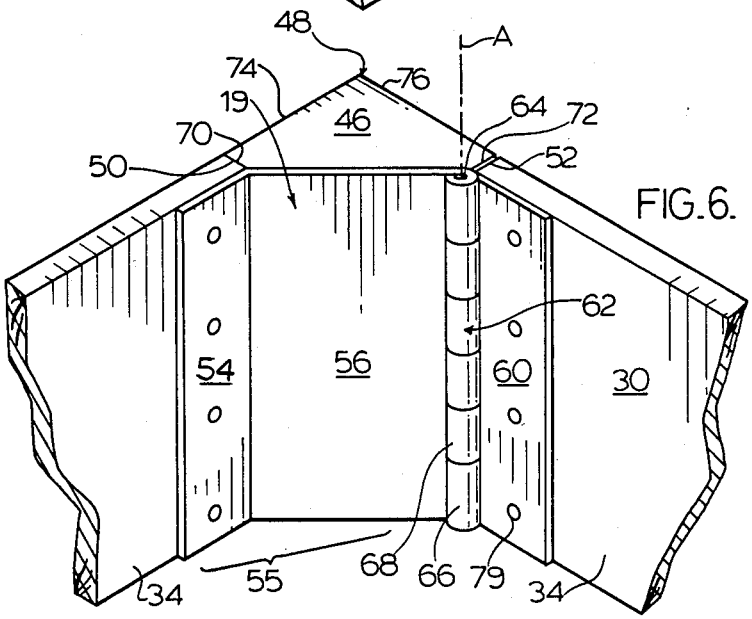
FIG. 6 is an enlarged perspective view of the inside of the corner of the frame shown in FIG. 4 in an open position.

Reference is now made to FIGS. 4 and 6 showing in greater detail the construction of one corner of the frame. The other three corners preferably have the same construction.

Side frame member 20 extends towards apex 48 but terminates spaced from apex 48 at end 50. Similarly frame segment 30 extends towards apex 48 but terminates spaced from apex 48 at end 52. Bracket member 19 has a first plate generally indicated 55 which comprises a first leg. 54 secured to the inner surface 34 of side frame member 20 and co-planar therewith and a second leg 56 which extends from end 50 of side frame member 20 diagonally across the corner to end 52 of frame segment 30. First plate 55 may be seen to be bent at a vertical fold line indicated as 58 in FIG. 4 so that an obtuse angle of preferably 135 degrees as shown in formed between first leg 54 and second leg 56.

Bracket member 19 also has a second plate 60 secured to the inner surface 34 of frame segment 30 coplanar therewith. First plate 55 and second plate 60 are cooperatively coupled to form a hinge 62 therebetween pivotable about vertical hinge pin 64. In this regard first plate 55 and second plate 60 have alternating curved edge portions 66 and 68 providing aligned blights in which pin 64 is journalled.

Hinge 62 permits side frame member 20 and frame segment 30 to pivot with respect to each other about a first vertical axis A coaxial with pin 64, and lying closely adjacent to inner surface 34 of frame segment 30 substantially in the plane thereof.

Bumper member 46 is securely coupled to end 50 of side frame member 20 as by having surface 70 glued thereto and preferably also affixed to the outer side of second leg 56 of the bracket member. With the frame in an open position as seen in FIG. 6, surface 72 of bumper member 46 is in close abutting contact with end 52 of frame segment 30. The bumper member has outer side surface 74 and outer end surface 76 which comprise co-planar continuations of the outer surfaces 32 of side frame member 20 and frame segment 30, merging therewith and extending to apex 48. In plan view bumper member 46 extends from apex 48 to both end 50 of side frame member 20 and end 52 of frame segment 30, with the bumper member substantially filling the space between apex 48 and ends 50 and 52 throughout the height of the frame.

From the open position, as seen in FIG. 6, side frame member 20 and frame segment 30 may be pivoted about axis A towards a collapsed position moving the inner surfaces 34 of each closer together as indicated by arrow B in FIG. 4. By so pivoting, end 52 of frame segment 30 pivots away from bumper member 46, that is, with end 52 pivoting away from surface 72 of the bumper member. Thus it may be seen that the first axis A has been located with respect to side frame member 20, frame segment 30 and bumper member 46 so that on pivoting of frame segment 30 relative to side frame member 20 from an open position towards a collapsed position, the bumper member does not become displaced relative to side frame member 20. By this arrangement bumper member 46 may be permanently affixed to side frame member 20.

As best seen in FIG. 4, the length of side surface 74 of bumper member 46 is greater than the thickness of frame segment 30, and the length of end surface 76 of bumper member 46 is greater than the thickness of side frame member 20. Bumper member 46 spaces the ends 50 and 52 of the frame members from apex 48 by a distance greater than the thickness of the frame members.

The first and second plates 55 and 60 are affixed to the frame members by screws indicated as 79 although many fastening devices are suitable. Apex 48 has been shown as a sharp, right angled apex but could be rounded if desired.

Figure 8:
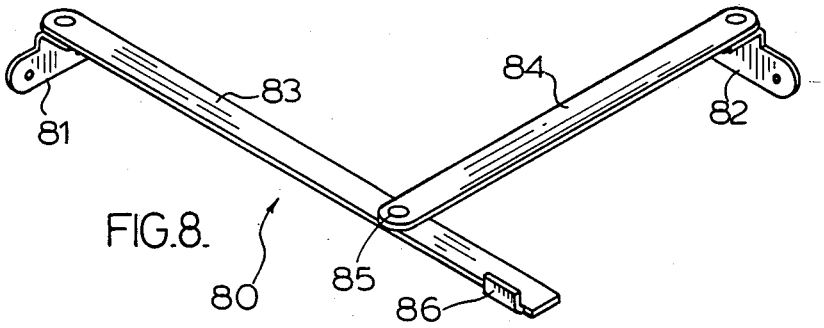
FIG. 8 is a perspective view of a reinforcing, positioner of the frame of FIG. 1.

Reinforcing positioner 80 is best shown in FIG. 8 as having two face plates 81 and 82 to be affixed to side-frame member 20 and frame segment 30. Arms 83 and 84 are hingedly coupled to plate 81 and 82 and together at pivot 85. Stop 86 on arm 83 contacts arm 84. Positioner 80, while optional, preferably prevents side frame member 20 and frame segment 30 from opening past a fully open position in which they are disposed at 90 degrees to each other.

Figure 5:
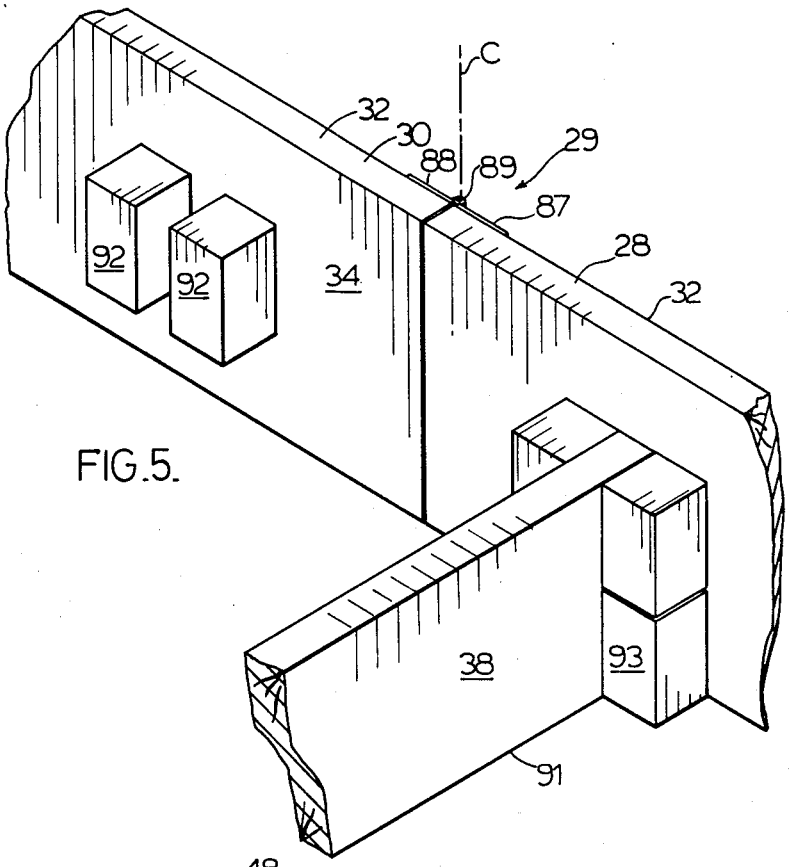
FIG. 5 is an enlarged perspective view of a central hinge and joist support structure of the frame of FIG. 1.

Reference is now made to FIG. 5 showing center hinge 29 as having two hinge halves 87 and 88 fixed to outer surfaces 32 of frame segments 28 and 30 for pivoting about a vertical pin 89, thus providing pivoting of frame segments 28 and 30 about a second vertical axis C. From a fully open position as seen in FIG. 5 with the frame segments 28 and 30 extending at 180 degrees from each other from hinge 29, the frame segments may be pivoted toward a collapsed position by moving exterior surfaces 32 of the two segments towards each other. As best seen in FIG. 3, in collapsing the frame, frame segments of each end frame member are pivoted about their center hinges moving the two center hinges closer together as indicated by arrows D at the same time as the segments are pivoted about hinges 62 thus moving side frame members 20 and 26 together as indicated by arrows E.

The frame can be folded to the fully collapsed position of FIG. 7 with outer surfaces 32 of frame segments 28 and 30 facing each other and side frame members 20 and 26 parallel. As seen in FIG. 7, hinges 62 space the side frame members from the frame segments by a sufficient distance that positioner 80 and support blocks 92 do not interfere with collapsing to the fully closed position as shown.

So that the frame may fully collapse, the distance from hinges 62 at opposite ends of side frame member 20 must be equal to or greater than twice the distance along frame segment 30 from hinge 62 to hinge pin 89.

FIGS. 1 and 5 best show joists 36 and 38 extending between frame segments at each end of the frame. All the joists have a bottom edge 91 which rests on cross rails 134, 136 and 138 of the frame support 12. The end of each joists 36 and 38 is vertically sidably received between two guide blocks 92 secured to the inside surface of the frame segments. Each joist 38 has two support blocks 93 secured thereto and upon which blocks 92 rest so that the joists 38 support the frame segments above cross rail 138. Joists 38 can be removed by sliding vertically downward relative to the frame segments. It is to be appreciated that the frame segments rest on the joists 38 with the joists resting on the cross rails.

Support blocks 95 are also provided on the inside surfaces of side frame members 20 and 26 and on interior locations on joists 38 at the same height as the tops of the joists and guide blocks 92 so as to provide surfaces upon which the removable flooring panels 40, 42 and 44 rest.

These panels may comprise sheets of plywood but preferably comprise a hollow core construction having a strong plywood bottom and a smooth press-board top spaced by an internal wood framework. The panels are suitably sized to provide a continuous flooring at a height above the joists inside of the frame members and bracket members.

In use, a complete kit including joists 36 and 38, panels 40, 42, and 44, and a collapsed frame as shown in FIG. 7 may be shipped in a suitably sized container. For use, the frame is unfolded from the collapsed position to the open position and placed on support 12 or on a floor. Joists 36 and 38 are slid vertically into place between blocks 92 and panels 40, 42 and 44 laid on top of the joists supported by the joists and support blocks 95. A mattress may then be placed on top of the panels.

Reference is now made to FIGS. 9 and 10 showing the frame of FIG. 1 adapted for use with a complementary hybrid waterbed mattress. The frame construction shown in FIGS. 9 and 10 is identical to that in FIGS. 1 to 8 with the important exception that flooring panels 40, 42 and 44 in FIG. 9 have a lesser thickness so that their upper surface 98 are at a height below the top of the frame 10.

As best seen in FIG. 9, the side frame members 20 and 26 have inner side surfaces 100, a top surface 102 and outer surfaces 104. Panels 40, 42 and 44 lie adjacent the inner side surface 100 with the inner side surface rising above the upper surface of the panels to top surfaces 102. Four elongate support block members are provided lying on the panels about the periphery of the panels with each support block members in abutment with side surfaces of a frame member adjacent thereto. The support blocks, of which three are shown as 106, 107 and 108, each have a thickness so that upper surfaces 110 of the support blocks are disposed at the same height as top surface 102 of the frame member. Upper surfaces 110 may be seen as a coplanar extension of top surface 102. The support block members preferably have mitred ends and abut in end-to-end relation as seen in FIG. 10.

Four elongate lateral support members are provided each overlying and associated with one of the four support block members. The lateral support members, of which three are shown as 116, 117 and 118, overlie both their respective support block members and the top surface 102 of the frame members. Peripheral, outer surfaces 120 of the lateral support members are vertically in-line with the outer surfaces 32 of the frame members with the outer surfaces 120 preferably a coplanar extension of outer surfaces 32.

Each lateral support member is coupled at its inner most, lower most edge to its underlying, associated support block by a hinge device indicated 122. Hinge 122 preferably is a strip of flexible material glued both to the lateral support member and the support block. The lateral support member may pivot about its inner, lower edge relative to the support block to raise its lower surface 124 off upper surface 110 of the support block and off of top surface 102.

Water-filled bladder 126 is provided in a central recess defined by the lateral support members supported by the panels preferably with an optional layer sheet of foamed plastic cushion 127 therebetween. Bladder 126 is preferably received in a water-impermeable safety liner 128 which has a single, major opening 130 in its upper surface Liner 128 extends between the bladder and the lateral support members. A -quilted mattress cover 132 overlies the bladder and lateral support members Cover 132 is tucked under the lateral support members between the lateral support member, and top surface 102 and upper surface 110. Optionally the edge of cover 132 may be detachable secured to the under surface of the lateral support members as, for example, by use of a VELCRO-type hook and eyelette tape or snap fasteners.

In use, the weight of the water 134 in water-filled bladder 126 acts on the coupled lateral support members and support block members to urge them outwardly and downwardly. This urges the support block members into abutting relation with the upstanding inner side surfaces 100 of the frame member so that the lateral support members provide lateral support to the bladder.

Each support block member preferably is rigid and may comprise a hollow structure with wood ribs covered by thin plywood not dissimilar to a construction for the panels 40, 42 and 44.

Each lateral support member preferably is a self-supporting, resiliently, deformable material, such as foamed plastic material The entire support member may comprise a piece of foamed polyurethane. Alternately, only inner and upper portions of the lateral support member may be deformable.

The cover is preferably a flexible material which does not stretch.

As best seen in FIG. 10, the lateral support members are arranged end-to-end in a co-operating manner to provide lateral support about the entire periphery of the bladder. Ends of lateral support members preferably abut in a mitred configuration similar to that for the block support members.

Each support block member and its associated lateral support member can be removed as unit to assist in reducing the volume occupied by the mattress for shipping and storage. With the support block member and its associated lateral support member merely resting on the base no tools are required for assembly. Disassembly of the mattress involves removing the cover, draining water from the bladder, collapsing the bladder, removing each support block member and its associated lateral support member, if present, folding or rolling up the flexible foam cushion and removing the flooring panels. The base may then be collapsed.

While the invention has been described with reference to preferred embodiment of the invention, it is not so limited. For a definition of the invention, reference is made to the accompanying claims.

What I claim is:

1. A collapsible base for a bed comprising:

(a) a foldable peripheral frame for a collapsible base, said peripheral frame assuming a rectangular configuration in an open position, said peripheral frame comprising:

(i) two horizontal elongate continuous frame members forming two opposite sides of the frame, each having two ends, (ii) two horizontal elongate split frame members forming two other opposite sides of the frame, each split frame member comprising (A) two elongate segments of equal length, each having a central end and an outer end, and (B) center hinge means hingedly coupling together the central ends of the segments for pivoting about a vertical axis, (iii) four corner hinge means, each hingedly coupling an outer end of one of the segments of the split frame members to an end of one of the continuous frame members for pivoting about a vertical axis, wherein with said frame in an open position movement of the center hinge means towards each other with pivoting of the segments about the center hinge means and complementary pivoting of the segments about the corner hinge means will move the continuous frame members towards each other to a collapsed position in which segments of each split frame member are folded upon each other to both lie substantially parallel to the continuous frame members, (b) a plurality of removable elongate joist members extending when the frame is in an open position between the split frame members spaced from each other, the joist members coupled at each of their ends to the split frame members, (c) support block means on inside surfaces of the continuous frame members, and (d) a plurality of removable support decking means supported within the frame in side by side abutting relation resting on the support blocks and joist members to provide a continuous horizontal support surface.

2. A collapsible base as claimed in claim 1 including, frame support means underlying the continuous frame members and joist members to support both raised above a floor with the continuous frame members and joist means resting on the frame support means, the joist members removably coupled at their ends to the split frame members so that the joist members support the split frame members.

3. A collapsible base as claimed in claim 2 wherein the frame support means comprises a collapsible frame work of elongate rail members comprising side rail members which lie under the continuous frame members parallel thereto and at least two cross rail members which extend between the side rail members transverse to the joist members under the joist member to support the joist members.

4. A collapsible bed as claimed in claim 1 in which the ends of the joist members are removably coupled to the split frame members by coupling means permitting uncoupling by relative sliding of the joist members vertically downwardly away from the split frame members, and wherein the split frame members are supported by the ends of the joist members.

5. A collapsible base as claimed in claim 1 wherein each corner hinge means comprises a resilient corner bumper member and a diagonal hinge bracket member, the corner bumper member coupled to the diagonal hinge bracket member outboard thereof to form an apex at each corner of the frame, the diagonal hinge bracket member extending from the end of a continuous frame member diagonally across the corner to the outer end of the segment of the split frame member at that corner so that the ends of both the continuous frame member and the segment are spaced from the apex at the corner, the vertical axis about which the corner hinge means is pivotable being located so that pivoting of the continuous frame member and segment between open and collapsed positions does not displace the corner bumper member relative to the continuous frame member.

6. A collapsible base as claimed in claim 5 wherein said bumper member consists of elastomeric, foamed plastic material.

7. A collapsible base as claimed in claim 6 wherein said corner bumper members have outer side and end surfaces which comprise co-planar continuations, respectively, of outer side and end surfaces of the continuous and split frame members.

8. A collapsible base as claimed in claim 1 wherein each segment of the split frame member has a length less than one half the length of the continuous frame members.

9. A collapsible base as claimed in claim 1 wherein said continuous frame members and said segments comprise elongate planks having uniform height and relatively thin thickness between inner and outer surfaces thereof to be disposed vertically in the frame.

10. A waterbed frame as claimed in claim 9 wherein each diagonal hinge bracket member is coupled to both its associated continuous frame member and segment to abut the inner surfaces thereof and with the vertical axis about which the continuous frame member and the segment pivot lying closely adjacent the inner surface of the segment near its outer end, and the ends of the continuous frame member and the segment are spaced from an apex at the nearest corner of the frame by a distance greater than the respective thickness of the continuous frame member and segment.

11. A collapsible base as claimed in claim 5 wherein the diagonal hinge bracket member comprises:

a first thin plate having a first leg and a second leg, the first leg lying co-planar with an inner surface of one of a continuous frame member and the second leg extending diagonally from the first leg across the corner to the outer end of the segment of the split frame member at that corner, a second thin plate lying co-planar with an inner surface of said segment of the split frame member at that corner, wherein the second leg of the first plate is hingedly coupled to the second plate for pivoting about a vertical axis.

12. A framework for confining a water-filled bladder of a waterbed, the framework comprising:

platform means for supporting the bladder, side wall means peripherally about the platform means rising upwardly above the periphery of the platform means, the side wall means having an inner wall surface adjacent and rising above the periphery of the platform means, a top surface at a height above the platform means and a peripheral outer wall surface, a plurality of elongate support block members arranged end-to-end on the platform means to encircle the periphery of the platform means forming a peripheral band thereabout with each support block member lying along side of and in abutment with the inner wall surface with the side wall means preventing outward sliding movement of each support block member, each support block member presenting an upper surface located at the same height as and comprising a co-planar extension of the top surface of the side wall means, lateral support means for extending about the periphery of the bladder to provide lateral support for the periphery of the bladder, the lateral support means comprising a plurality of lateral support members, each coupled to an associated one of the support block members, each lateral support member overlying its associated support block member and the top surface of the side wall means adjacent thereto with an outer surface of each lateral support member comprising a coplanar extension of the outer wall surface of the side wall means adjacent thereto.

a lower innermost edge of each lateral support member coupled by hinge means to its associated support block member to enable the lateral support member to pivot upward away from the top surface of the side wall means and its associated support block member, each lateral support member and its associated block support member being removable as an integral element.

* * * * *